US009942653B2

(12) United States Patent
Akino

(10) Patent No.: US 9,942,653 B2
(45) **Date of Patent: *Apr. 10, 2018**

(54) NARROW-ANGLE DIRECTIONAL MICROPHONE

(71) Applicant: Hiroshi Akino, Kanagawa (JP)

(72) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/289,332

(22) Filed: Oct. 10, 2016

(65) Prior Publication Data

US 2017/0164098 A1 Jun. 8, 2017

(30) Foreign Application Priority Data

Dec. 3, 2015 (JP) ..... 2015-236428

(51) Int. Cl.
*H04R 1/34* (2006.01)
*H04R 1/22* (2006.01)
*H04R 1/08* (2006.01)

(52) U.S. Cl.
CPC ..... *H04R 1/342* (2013.01); *H04R 1/083* (2013.01); *H04R 1/222* (2013.01)

(58) Field of Classification Search
CPC ..... H04R 1/02; H04R 1/326; H04R 1/342; H04R 19/04; H04R 29/004; G10D 13/024
USPC ..... 381/26, 174, 176, 177, 191, 313, 346, 381/356, 357, 358, 360, 94.9, 151, 190, 381/345; 600/25; 607/57
See application file for complete search history.

(56) References Cited

U.S. PATENT DOCUMENTS 4,410,770 A * 10/1983 Hagey ..... H04R 1/38 181/151
4,456,796 A * 6/1984 Nakagawa ..... H04R 19/016 307/400
4,862,507 A * 8/1989 Woodard ..... H04R 1/08 381/358
5,878,147 A * 3/1999 Killion ..... H04R 1/406 381/313
6,151,399 A * 11/2000 Killion ..... H04R 1/38 381/313

(Continued)

FOREIGN PATENT DOCUMENTS

JP 6-48294 U 6/1994
JP 6-81352 10/1994

*Primary Examiner* — Gerald Gauthier
(74) *Attorney, Agent, or Firm* — Whitham, Curtis & Cook, P.C.

(57) ABSTRACT

A narrow-angle directional microphone includes: a microphone case; an acoustic tube fit in the microphone case with a gap between the acoustic tube and the microphone case; a microphone element arranged at one end side of the acoustic tube with a clearance that allows a front acoustic terminal and a rear acoustic terminal to communicate into each other between the microphone element and the microphone case; and an acoustic resistance body having elasticity positioned over between the one end side of the acoustic tube and the microphone element to block a passage between the front acoustic terminal and the rear acoustic terminal, whereby adjustments of a degree of compression of the acoustic resistance body are achieved by changes to an interval between the acoustic tube and the microphone element.

11 Claims, 3 Drawing Sheets

(56) References Cited

U.S. PATENT DOCUMENTS 6,516,228 B1 * 2/2003 Berrang ..... H04R 25/606 607/57
7,881,486 B1 * 2/2011 Killion ..... H04R 25/402 381/313
8,675,897 B2 * 3/2014 Fukuda ..... H04R 1/1075 381/151
9,118,989 B2 * 8/2015 Zukowski ..... H04R 1/086
9,378,714 B1 * 6/2016 Baldwin, Sr. ..... G10D 13/024
9,609,426 B2 * 3/2017 Akino ..... H04R 1/342
9,741,324 B2 * 8/2017 Baldwin, Sr. ..... G10D 13/024
9,788,132 B2 * 10/2017 Akino ..... H04R 29/004
2002/0177883 A1 * 11/2002 Tziviskos ..... H04R 5/02 607/57
2006/0078145 A1 * 4/2006 Akino ..... H04R 1/086 381/356
2006/0222196 A1 * 10/2006 Uchimura ..... H04R 1/342 381/356
2006/0274913 A1 * 12/2006 Akino ..... H04R 1/342 381/357
2006/0285714 A1 * 12/2006 Akino ..... H04R 1/326 381/356
2008/0101630 A1 * 5/2008 Akino ..... H04R 19/04 381/190
2010/0172531 A1 * 7/2010 Burns ..... H04R 1/326 381/345
2010/0260369 A1 * 10/2010 Suzuki ..... H04R 1/342 381/360
2010/0278355 A1 * 11/2010 Yamkovoy ..... G10K 11/178 381/94.9
2011/0200221 A1 * 8/2011 Akino ..... H04R 1/083 381/356
2011/0222718 A1 * 9/2011 Akino ..... H04R 1/083 381/356
2012/0014542 A1 * 1/2012 Akino ..... H04R 1/406 381/174
2012/0263333 A1 * 10/2012 Akino ..... H04R 9/08 381/356
2013/0034256 A1 * 2/2013 Akino ..... H04R 9/08 381/356
2013/0051600 A1 * 2/2013 Akino ..... H04R 1/342 381/356
2013/0064409 A1 * 3/2013 Ikeda ..... H04R 1/08 381/356
2013/0216084 A1 * 8/2013 Akino ..... H04R 1/342 381/346
2013/0272558 A1 * 10/2013 Akino ..... H04R 1/326 381/356
2014/0376752 A1 * 12/2014 Akino ..... H04R 1/08 381/176
2015/0038774 A1 * 2/2015 Poulsen ..... H04R 25/00 600/25
2015/0358741 A1 * 12/2015 Akino ..... H04R 1/38 381/174
2016/0021455 A1 * 1/2016 Akino ..... H04R 1/326 381/356
2016/0037259 A1 * 2/2016 Akino ..... H04R 5/027 381/26
2016/0094919 A1 * 3/2016 Akino ..... H04R 19/04 381/174
2016/0241952 A1 * 8/2016 Akino ..... H04R 1/342
2016/0269821 A1 * 9/2016 Akino ..... H04R 1/342
2016/0373865 A1 * 12/2016 Akino ..... H04R 19/04
2017/0164098 A1 * 6/2017 Akino ..... H04R 1/342
2017/0171680 A1 * 6/2017 Akino ..... H04R 1/04
2017/0180849 A1 * 6/2017 Akino ..... H04R 1/326

* cited by examiner

NARROW-ANGLE DIRECTIONAL MICROPHONE

BACKGROUND

Technical Field

The present invention relates to a narrow-angle directional microphone.

Related Art

The inventor of the present application invented a narrow-angle directional microphone having a primary sound pressure gradient microphone element (hereinafter, the microphone element may be simply referred to as "microphone element") built in an acoustic tube, and previously filed a patent application (see JP 6-81352 B2).

In the narrow-angle directional microphone described in JP 6-81352 B2, a front acoustic terminal and a rear acoustic terminal of the primary sound pressure gradient element are acoustically connected in a clearance formed between an outer peripheral side of the element and an inner peripheral side of the acoustic tube.

The acoustic terminal is a position of air that effectively provides a sound pressure to a microphone unit, in other words, the acoustic terminal is a central position of air moving at the same time with a diaphragm included in the microphone unit.

If the acoustic connection is made sparse, the directivity gets close to omni-directivity, low-range sensitivity becomes low, low-range directivity becomes broad, and wind noise is more likely to occur. If the acoustic connection is made dense, the directivity gets close to bidirectivity, the low-range sensitivity becomes high, the low-range directivity becomes narrow, and the wind noise is less likely to occur. Therefore, if the degree of the acoustic connection can be changed, sounds can be collected under a setting adapted to an environmental condition.

The present invention includes, as described below, a dual tube structure in which the acoustic tube is held in a microphone case. A narrow-angle directional microphone including the dual tube structure is known in JP 6-48294 U, and the like.

SUMMARY

An objective of the present invention is to enable sound collection under a setting adapted to an environmental condition, in a narrow-angle directional microphone in which a front acoustic terminal and a rear acoustic terminal are acoustically connected in a clearance formed between an outer peripheral side of an element and an inner peripheral side of an acoustic tube.

The main characteristic of the present invention is in including: a microphone case; an acoustic tube fit in the microphone case with a gap between the acoustic tube and the microphone case; a microphone element arranged at one end side of the acoustic tube with a clearance that allows a front acoustic terminal and a rear acoustic terminal to communicate into each other between the microphone element and the microphone case; and an acoustic resistance body having elasticity positioned between the one end side of the acoustic tube and the microphone element to be positioned over a passage between the front acoustic terminal and the rear acoustic terminal, whereby adjustments of the degree of compression of the acoustic resistance body are achieved by changes to an interval between the acoustic tube and the microphone element.

A narrow-angle directional microphone that can change an acoustic resistance value of an acoustic resistance body by adjusting the degree of compression of the acoustic resistance body. This allows preforming sound collection under a setting adapted to an environmental condition to be obtained.

DETAILED DESCRIPTION

Hereinafter, embodiments of a narrow-angle directional microphone according to the present invention will be described with reference to the drawings.

First Embodiment

Figure 1:
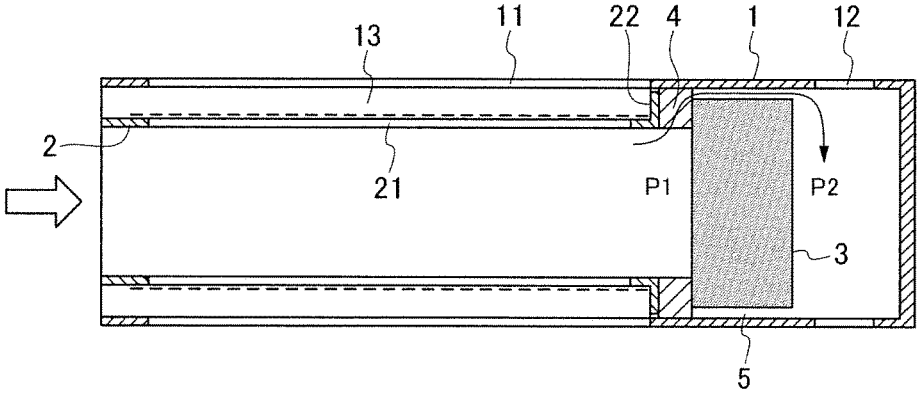
FIG. 1 is a vertical sectional view illustrating an embodiment of a narrow-angle directional microphone according to the present invention.
Figure 2:
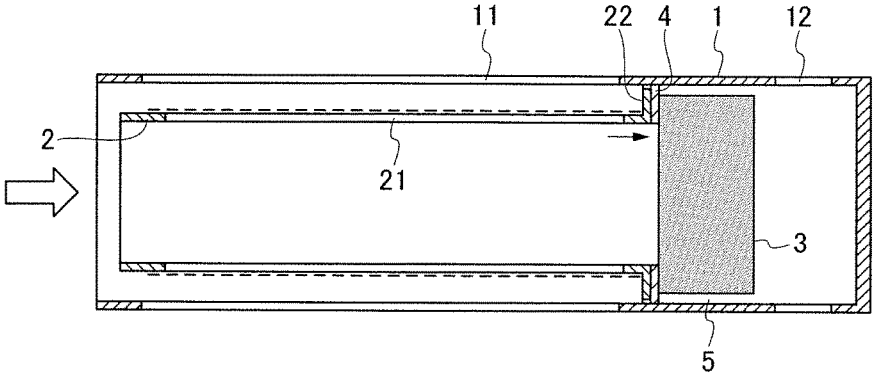
FIG. 2 is a vertical sectional view illustrating a different form of the narrow-angle directional microphone.

In FIGS. 1 and 2, a narrow-angle directional microphone includes a cylindrical microphone case 1, and a cylindrical acoustic tube 2 is fit in the microphone case 1. A flange 22 is formed in a right end in FIG. 1 of the acoustic tube 2. An outer periphery of the flange 22 is in contact with an inner peripheral surface of the microphone case 1, and the microphone case 1 and the acoustic tube 2 are fit into each other, sharing a central axis line. The flange 22 is slidable along the inner peripheral surface of the microphone case 1, and therefore the acoustic tube 2 is movable in a central axis line direction with respect to the microphone case 1.

A gap 13 corresponding to the amount of extension outward in a radial direction, of the flange 22, is created in a cylindrical shape between the inner peripheral surface of the microphone case 1 and an outer peripheral surface of the acoustic tube 2. An introduction hole 11 of sound wave is formed in a peripheral wall of the microphone case 1, and an introduction hole 21 of sound wave is also formed in a peripheral wall of the acoustic tube 2. Further, a sound wave introduction hole 12 is formed in a peripheral wall of the microphone case 1 at a rear side of a microphone element 3.

In FIGS. 1 and 2, the left side is a front side of the microphone. The microphone element 3 is arranged in the microphone case 1 at one end side of the acoustic tube 2, that is, at a "depth" side of the acoustic tube 2 in the example of the illustration. An end portion at the depth side of the microphone case 1 is blocked. The electroacoustic conversion method of the element 3 is arbitrary, and may be a condenser-type method, a dynamic-type method, or a ribbon-type method.

The microphone element 3 includes a front acoustic terminal P1 and a rear acoustic terminal P2. The microphone element 3 is arranged in the microphone case 1 with a clearance 5 between the inner peripheral surface of the microphone case 1 and an outer peripheral surface of the microphone element 3 by an appropriate support structure. The clearance 5 is a cylindrical clearance, and allows the front acoustic terminal P1 and the rear acoustic terminal P2 of the microphone element 3 to communicate into each other. The front acoustic terminal P1 is set with the sound wave introduction hole 11, and the rear acoustic terminal P2 is set with the sound wave introduction hole 12.

An acoustic resistance body 4 lies between one end side of the acoustic tube 2 and the microphone element 3, to be specific, between the flange 22 of the acoustic tube 2 and a front-end outer peripheral portion of the microphone element 3. The acoustic resistance body 4 is formed of a material having elasticity in a ring shape. An outer peripheral surface of the acoustic resistance body 4 is in contact with the inner peripheral surface of the microphone case 1. The acoustic resistance body 4 is positioned over an entrance of a sound wave from a front acoustic terminal P1 side of the microphone element 3 to the clearance 5. The acoustic resistance body 4 is configured to restrict flow of a sound wave passing through a passage between the front acoustic terminal P1 and the rear acoustic terminal P2.

The acoustic tube 2 is movable in the central axis line direction with respect to the microphone case 1, as described above, by an appropriate adjustment mechanism, and movement of the acoustic tube 2 can change an interval between the acoustic tube 2 and the microphone element 3 in the central axis line. By the change of the interval, the degree of compression of the acoustic resistance body 4 by the flange 22 of the acoustic tube 2 can be adjusted. Adjustments of an acoustic resistance of the passage between the front acoustic terminal P1 and the rear acoustic terminal P2 are achieved by adjustment of a degree of compression of the acoustic resistance body 4. FIG. 1 illustrates a state in which the degree of compression is small, and the acoustic resistance body 4 is relaxed and an acoustic resistance value is small. FIG. 2 illustrates a state in which the degree of compression is large, and the acoustic resistance body 4 is compressed and the acoustic resistance value is large.

As is known, in the narrow-angle directional microphone, a sound wave entering the acoustic tube 2 through the introduction holes 11 and 21, and a sound wave going around the acoustic tube 2 and entering the front of the acoustic tube 2, the sound waves being from a sound source existing at a side of the microphone case 1, interfere with each other and attenuate. Therefore, the narrow-angle directional microphone responds well to a sound wave from the sound source existing in front of the acoustic tube 2, and can obtain narrow-angle directivity.

According to the above-described embodiment, in the state where the degree of compression of the acoustic resistance body 4 is small and the acoustic resistance value is small, as illustrated in FIG. 1, the sound wave introduced from the front of the microphone element 3 to the acoustic tube 2, as illustrated by the outlined arrow, passes through the acoustic resistance body 4 and the clearance 5, as illustrated by the black arrow, and is led into the microphone case 1 in which the sound wave introduction hole 12 is formed, at the rear of the microphone element 3. Accordingly, the degree of connection between the front acoustic terminal P1 and the rear acoustic terminal P2 of the element 3 becomes dense. Therefore, the directivity gets close to bidirectivity, the low-range sensitivity becomes high, the low-range directivity becomes narrow, and the wind noise is less likely to occur.

In the state where the degree of compression of the acoustic resistance body 4 is large and the acoustic resistance value is large, as illustrated in FIG. 2, the degree of connection between the front acoustic terminal P1 and the rear acoustic terminal P2 of the microphone element 3 becomes sparse. The sound wave introduced into the acoustic tube 2 from the front of the microphone element 3, as illustrated by the arrow, is not led into the microphone case 1 at the rear of the microphone element 3. Therefore, the directivity gets close to omni-directivity, the low-range sensitivity becomes low, the low-range directivity becomes broad, and wind noise is more likely to occur.

The state illustrated in FIG. 1 and the state illustrated in FIG. 2 can be easily obtained by adjusting the position of the acoustic tube 2 with respect to the microphone case 1. Therefore, according to the above-described embodiment, by adjusting the degree of acoustic connection between the front acoustic terminal P1 and the rear acoustic terminal P2 of the primary sound pressure gradient element, sounds can be collected under a setting adapted to a sound collection status.

Second Embodiment

Figure 3:
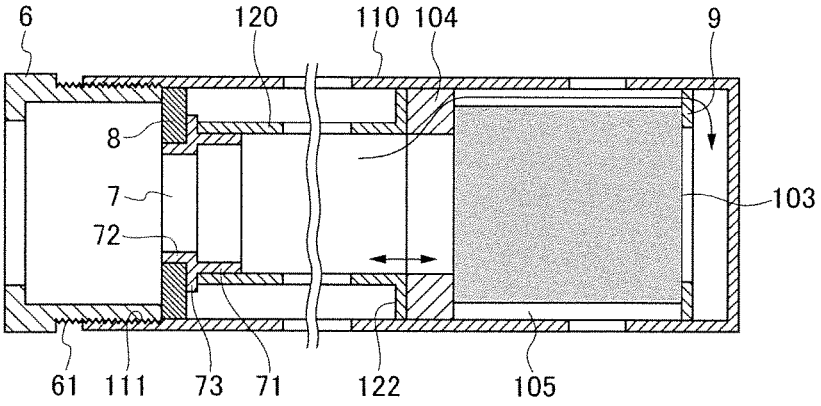
FIG. 3 is a vertical sectional view illustrating another embodiment of a narrow-angle directional microphone according to the present invention.

Next, a second embodiment specifically describing a position adjustment mechanism of an acoustic tube with respect to a microphone case will be described with reference to FIG. 3. A microphone element 103 is arranged inside a rear end portion of a microphone case 110. The microphone case 110 and an acoustic tube 120 have substantially similar configurations to the microphone case 1 and the acoustic tube 2 of the first embodiment, and realize a narrow-angle directional microphone.

A fixing ring 9 is fixed near a rear end (a right end in FIG. 3) of the microphone case 110 in the microphone case 110. A rear-end outer peripheral portion of the microphone element 103 is in contact with the fixing ring 9, and the microphone element 103 is positioned. The fixing ring 9 has a hole that allows a sound wave to pass through. The microphone element 103 is fixed in the microphone case 110 by an appropriate fixing structure, in addition to the positioning by the fixing ring 9. A clearance 105 is formed between an inner peripheral surface of the microphone case 110 and the microphone element 103.

The clearance 105 allows a front acoustic terminal and a rear acoustic terminal of the microphone element 103 to communicate with each other, together with the hole of the fixing ring 9, which allows the sound wave to pass through. A ring-shaped acoustic resistance body 104 lies between a front-end (a left-end in FIG. 3) outer peripheral edge portion of the microphone element 103 and a flange 122 formed in a rear end of the acoustic tube 120. The acoustic resistance body 104 is formed of a material having elasticity, and an outer peripheral surface of the acoustic resistance body 104 is in contact with the inner peripheral surface of the microphone case 110. The acoustic resistance body 104 is positioned over entrance of the sound wave from a front acoustic terminal side of the microphone element 103 to the clearance 105.

A front end portion of the acoustic tube 120 is supported at an inner peripheral side of the microphone case 110 by an auxiliary ring 7 and a receiving ring 8. Details of this support structure are as follows. The auxiliary ring 7 includes a flange 73 in an intermediate portion in a central axis line direction, a cylindrical portion 71 at a rear side of the flange 73, and a cylindrical portion 72 at a front side of the flange 73. The cylindrical portion 71 is fit in an inner periphery of the front end portion of the acoustic tube 120. The receiving ring 8 is fit in an outer periphery of the cylindrical portion 72. An outer peripheral surface of the receiving ring 8 is in contact with the inner peripheral surface of the microphone case 110.

The microphone case 110 includes a head cap 6 that can adjust an entry depth to the microphone case 110, in a front end portion. The microphone case 110 includes a female screw 111 in an inner peripheral side of the front end portion, and a male screw 61 formed in an outer periphery of the head cap 6 is screwed in the female screw 111. The entry depth of the head cap 6 relative to the microphone case 110 is adjustable by screwing or unscrewing the head cap 6 and microphone case 110 can be adjusted.

When the entry depth of the head cap 6 to the microphone case 110 is adjusted, the receiving ring 8 can be moved in the central axis line direction of the microphone case 110 along an inner peripheral surface of the acoustic tube 120 while being in contact with the inner peripheral surface of the acoustic tube 120. When the head cap 6 is screwed into the microphone case 110, the receiving ring 8 is pushed by the head cap 6, and the receiving ring 8, the auxiliary ring 7, and the acoustic tube 120 are integrally moved toward the element 103. With the movement of the acoustic tube 120, a distance between the flange 122 of the acoustic tube 120 and the element 103 (i.e., an "interval") becomes narrow, the acoustic resistance body 104 is compressed and an acoustic resistance value becomes large, and the degree of connection between the front acoustic terminal and the rear acoustic terminal of the microphone element 103 becomes sparse.

When the screwing of the head cap 6 to the microphone case 110 is loosened, e.g., "unscrewed", the receiving ring 8, the auxiliary ring 7, and the acoustic tube 120 are integrally moved in a direction away from the microphone element 103 by elastic force of the acoustic resistance body 104. With the movement of the acoustic tube 120, the distance or "interval" between the flange 122 of the acoustic tube 120 and the microphone element 103 is enlarged, the acoustic resistance body 104 is relaxed and the acoustic resistance value becomes low, and the degree of connection between the front acoustic terminal and the rear acoustic terminal of the microphone element 103 becomes dense.

As described above, according to the second embodiment, the entry depth of the head cap 6 to the microphone case 110 is adjustable. When the entry depth of the head cap 6 is adjusted, the interval between the acoustic tube 120 and the microphone element 103 in the central axis line direction can be changed, and the degree of compression of the acoustic resistance body 104 can be adjusted. By the adjustment of the degree of compression of the acoustic resistance body 104, the acoustic resistance value of the acoustic resistance body 104 can be adjusted. The acoustic resistance value of the acoustic resistance body 104 influences the acoustic resistance value of a path of the sound wave from the front acoustic terminal to the rear acoustic terminal of the microphone element 103. Therefore, when the entry depth of the head cap 6 is adjusted, the degree of acoustic connection between the front acoustic terminal and the rear acoustic terminal of the primary sound pressure gradient element is adjusted, and the sounds can be collected under a setting adapted to a sound collection status.

What is claimed is:

1. A narrow-angle directional microphone comprising:

a microphone case;

an acoustic tube fit in the microphone case with a gap between the acoustic tube and the microphone case;

a microphone element arranged at one end side of the acoustic tube with a clearance that allows a front acoustic terminal and a rear acoustic terminal to communicate into each other between the microphone element and the microphone case; and an acoustic resistance body having elasticity positioned between the one end side of the acoustic tube and the microphone element to be positioned over a passage between the front acoustic terminal and the rear acoustic terminal, whereby adjustments of a degree of compression of the acoustic resistance body are achieved by changes to an interval between the acoustic tube and the microphone element.

2. The narrow-angle directional microphone according to claim 1, wherein the acoustic tube includes a flange being in contact with an inner peripheral surface of the microphone case at the one end side, and the acoustic resistance body lies between the flange and the microphone element.

3. The narrow-angle directional microphone according to claim 1, wherein the acoustic resistance body has a ring-shaped member, and an outer peripheral surface of the acoustic resistance body is in contact with an inner peripheral surface of the microphone case.

4. The narrow-angle directional microphone according to claim 1, wherein the microphone case includes a head cap capable of adjusting an entry depth to the microphone case, in a front end portion, and the interval between the acoustic tube and the microphone element is able to be changed by adjustment of the entry depth of the head cap.

5. The narrow-angle directional microphone according to claim 4, wherein an auxiliary ring is positioned between the head cap and a front end portion of the acoustic tube.

6. The narrow-angle directional microphone according to claim 5, wherein one end portion of the auxiliary ring and the front end portion of the acoustic tube are fit into each other, and a receiving ring fit in the other end portion of the auxiliary ring is in contact with the head cap.

7. The narrow-angle directional microphone according to claim 6, wherein the receiving ring is movable together with the head cap, the auxiliary ring, and the acoustic tube along an inner peripheral surface of the acoustic tube while being in contact with the inner peripheral surface of the acoustic tube.

8. The narrow-angle directional microphone according to claim 1, wherein an end of the microphone element at an opposite side to an arrangement side of the acoustic resistance body is in contact with a fixing ring, and the microphone element is positioned.

9. The narrow-angle directional microphone according to claim 8, wherein the fixing ring includes a hole that allows the front acoustic terminal and the rear acoustic terminal to communicate with each other, and an outer periphery is fixed to an inner periphery of the microphone case.

10. The narrow-angle directional microphone according to claim 1, wherein adjustments of an acoustic resistance of the passage are achieved by adjustment of a degree of compression of the acoustic resistance body.

11. The narrow-angle directional microphone according to claim 1, wherein the acoustic resistance body are configured to restrict flow of a sound wave passing through the passage.

* * * * *